United States Patent [19]

Teramachi

[11] 4,114,517

[45] Sep. 19, 1978

[54] DOUBLE ACTING ACTUATOR

[76] Inventor: Hiroshi Teramachi, 2-34-8 Higashi-tamagawa Setagaya-ku, Tokyo, Japan

[21] Appl. No.: 771,667

[22] Filed: Feb. 24, 1977

Related U.S. Application Data

[63] Continuation of Ser. No. 655,446, Feb. 5, 1976, abandoned.

[30] Foreign Application Priority Data

Jun. 24, 1975 [JP] Japan ..... 50-078463
Oct. 16, 1975 [JP] Japan ..... 50-124565

[51] Int. Cl.[2] ..... F01B 21/02

[52] U.S. Cl. ..... 92/2; 92/33; 92/71; 92/116; 92/165 PR; 92/177

[58] Field of Search ..... 92/2, 31, 33, 70, 71, 92/85 A, 116, 165 PR, 173, 177

[56] References Cited

U.S. PATENT DOCUMENTS

| | | | |
|---|---|---|---|
| 2,918,799 | 12/1959 | Geyer | 92/33 |
| 2,955,579 | 10/1960 | Block | 92/165 PR |
| 3,090,244 | 5/1963 | Davis | 92/31 |
| 3,183,792 | 5/1965 | Allen | 92/33 |
| 3,763,747 | 10/1973 | Beichel | 92/33 |
| 3,776,106 | 12/1973 | Pish | 92/33 |
| 3,823,651 | 7/1974 | Ogilvie | 92/2 |
| 3,905,278 | 9/1975 | Ourdouillie | 92/85 A |
| 3,961,559 | 6/1976 | Teramachi | 91/412 |

FOREIGN PATENT DOCUMENTS

| | | | |
|---|---|---|---|
| 1,954,780 | 5/1971 | Fed. Rep. of Germany | 92/33 |

*Primary Examiner*—Martin P. Schwadron
*Assistant Examiner*—Abraham Hershkovitz
*Attorney, Agent, or Firm*—McGlew and Tuttle

[57] ABSTRACT

The actuator comprises a cylinder of non-circular cross section having three ports and a center axis, three pistons and a piston rod which is provided with at least one male thread having a pre-determined helical angle at a pre-determined pitch. One of the pistons is mounted on the piston rod for rotation relative thereto while being fixed against axial displacement therealong, and the other two pistons are provided with at least one female spiral thread engaged with the male spiral thread on the piston rod, while being maintained at a small spacing therebetween. Thus, the piston rod can reciprocate in the cylinder in opposite axial directions and can rotate, relative to the cylinder, in opposite angular directions, and further, an accurate positioning of the piston rod can be effected at a beginning and/or an end of an operating cycle thereof.

4 Claims, 6 Drawing Figures

DOUBLE ACTING ACTUATOR

BACKGROUND OF THE INVENTION

1. FIELD OF THE INVENTION

The present invention relates in general to an improved double acting actuator which is widely used in hydraulic power transmissions which are required to move accurately, such as a transfer machine, an automatic stock feed, etc., and, in particular, to a new and useful type of an actuator of which a piston rod can reciprocate in the cylinder in opposite axial directions and can rotate, relative to the cylinder, in opposite angular directions, and further, an accurate positioning of the piston rod can be effected at a beginning and/or an end of operation movements thereof.

DESCRIPTION OF THE PRIOR ART

There are known piston cylinder actuators operable by the pressure of hydraulic fluid. In particular, my U.S. Pat. application Ser. No. 524,997 now U.S. Pat. No. 3,961,559, issued June 8, 1976, discloses an actuator which comprises a cylinder of non-circular cross section, two types of pistons and a piston rod which is provided with at least one male spiral thread having a pre-determined helical angle at a pre-determined pitch. Of course, although the piston rod of such actuator according to the U.S. Pat. No. 3,961,559 can more accurately effect longitudinal and/or rotary movements in comparison with a piston rod of a conventional actuator having a cylinder of circular cross section, the actuator is still insufficient with respect to locating the piston rod thereof accurately at a beginning and/or an end of an operating cycle thereof.

SUMMARY OF THE INVENTION

In accordance with the present invention, the improved double acting actuator comprises a cylinder of non-circular cross section a center axis and three apertures, slots, or ports, through which the hydraulic fluid is supplied and is exhausted through a selector valve, such as a solenoid valve, three types of pistons, i.e. first piston, second piston and third piston, watertightly movable in the cylinder, dividing the cylinder interior into three chambers, i.e. first and second end chambers and an intermediate chamber, and forming a very small space between the first and second pistons, and a piston rod having at least one male spiral thread at pre-determined pitch and helical angle. The piston rod extends coaxially along the center axis of the cylinder and in watertight relation through the centers of the three pistons. The piston rod also extends through end walls closing the opposite ends of the cylinder. The third piston is mounted on the piston rod and is rotatable on the piston rod while being restrained against axial movement therealong. The first and second pistons are provided with at least one respective female spiral thread engaged with the male spiral thread on the piston rod. Three apertures, slots, or ports are formed in the cylinder and each opens to a respective one of the three chambers.

Accordingly, it is an object of the present invention to provide an actuator having a high degree of accuracy in an operating cycle of the piston rod, and, in particular, in positioning the piston rod at a begining and/or an end of the operating cycle thereof.

It is another object of the present invention to provide an actuator which can effect some types of cyclic movements consisting of an association of the rotary and longitudinal movements by means of varying respective hydraulic fluid pressures in the three chambers of the cylinder.

A more detailed explanation of the present invention is provided in the following description, and is illustrated in the accompanying drawings.

DESCRIPTION OF THE PREFERRED EMBODIMENTS

Figure 2:
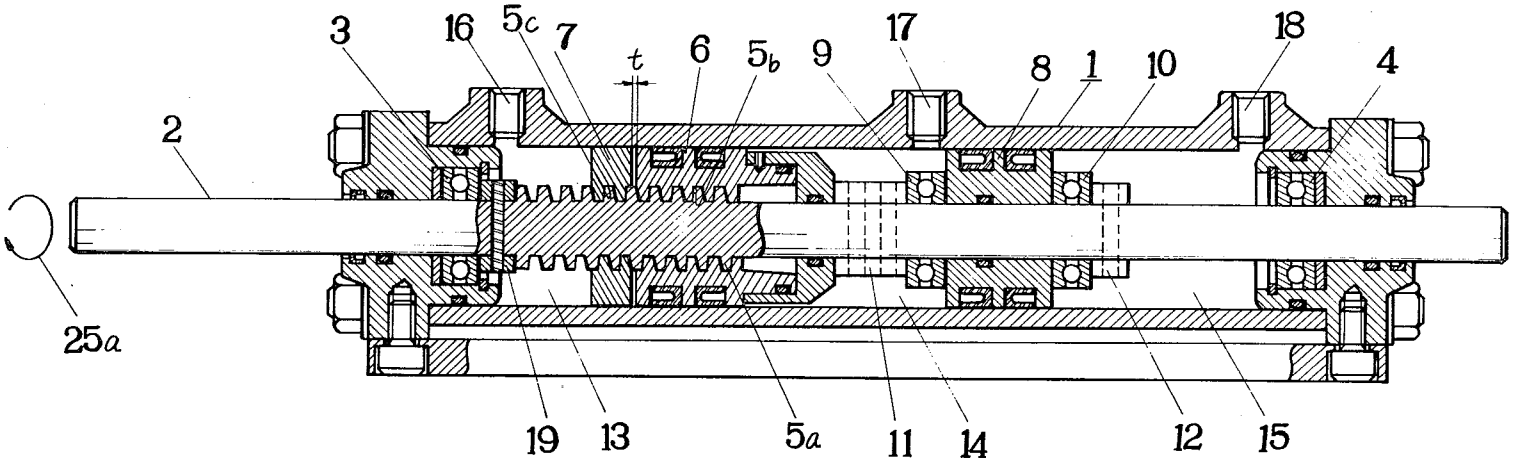
FIGS. 2, 3 and 5 are longitudinal sectional views corresponding to FIG. 1 and showing second, third and fourth states of the operating cycle movements, respectively.
Figure 3:
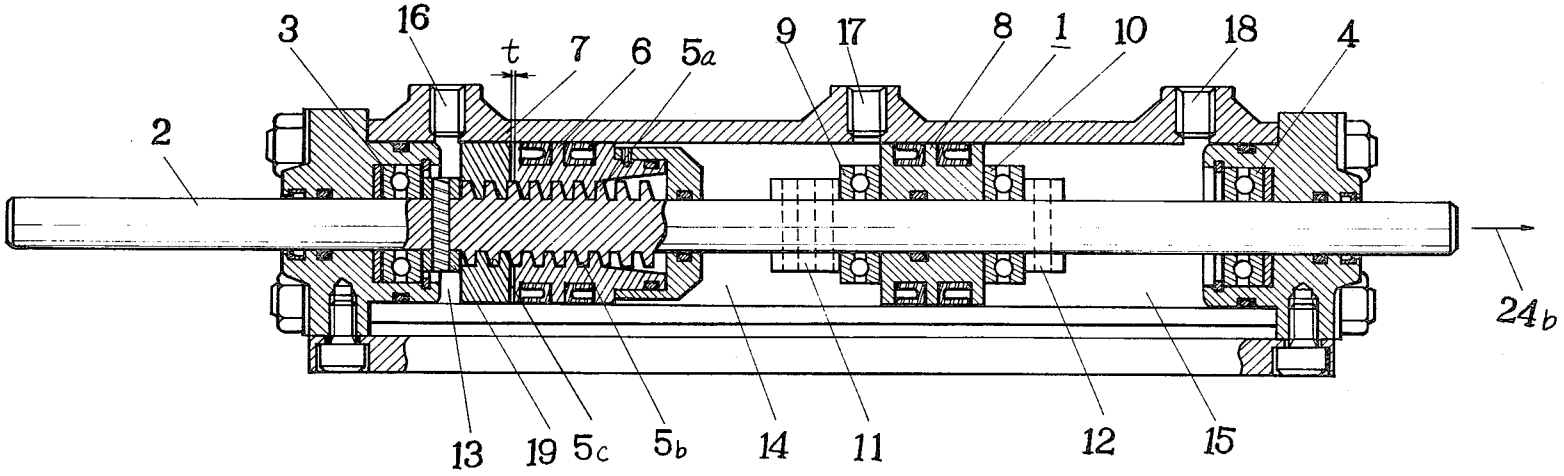
Figure 4:
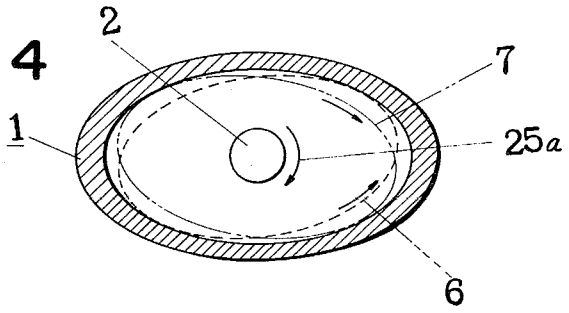
FIG. 4 is a sectional explanation view showing a relation of locations of the first and second pistons and the cylinder in FIG. 3.

Referring to FIGS. 1 through 3 and 5, there is shown one type of an improved double acting actuator according to the present invention. The actuator comprises a cylinder 1, two end walls 21*a* and 21*b* closing the opposite ends of the cylinder 1, three types of pistons, i.e. a first piston 6, a second piston 7 and a third piston 8, and a piston rod 2 which is watertightly extended through the three pistons and the end walls. The cylinder 1 of the actuator is of oval cross section as shown in FIG. 4. Each end wall is provided with a respective thrust bearing 3 or 4. Thereby, the piston rod 2 is located coaxially along a center axis of the cylinder 1 and is supported movably between the two end walls 21*a* and 21*b*. The piston rod 2 is provided with plural male spiral threads 5*a* having a pre-determined helical angle at a pre-determined pitch. Three types of pistons 6, 7 and 8 are movable in the cylinder 1 and divide the cylinder interior into three chambers, i.e. first and second end chambers 13 and 15 and an intermediate chamber 14, while forming a very small space *t* between the first and second pistons 6 and 7. The first piston 6 is provided with an end wall 26*a* of an inverted C-shaped cross section and has a pair of rubber packings 22*a* and 22*b*, thereby providing water-tight sealing between the first piston 6 and the inside wall of the cylinder 1. The first piston 6 is further provided with plural female spiral threads 5*b* which are watertightly and movably engaged with the plural male spiral threads 5*a* on the piston rod 2. The second piston 7 also is provided with plural female spiral threads 5*c* which are movably engaged with the plural male spiral threads 5*a* on the piston rod 2, but it is not necessary to maintain a water-tight seal between the second piston 7 and the inside wall of the cylinder 1. The second piston 7 is restricted by a stop ring 19 in the movement in the left direction in FIG. 1. The third piston 8 is locked against axial movement relative to the piston rod 2 by two stop rings 11 and 12 and two thrust bearings 9 and 10 are interposed between stop rings 11 and 12 and the opposite ends of the third piston 8, respectively. The piston rod 2 is rotatable relative to the third piston 8. The cylinder 1 is provided with three ports 16, 17 and 18 through which the hydraulic fluid is supplied and exhausted through a selector valve, such as a solenoid valve, etc. (not shown). The port 16 is opened to the first end chamber 13 in the cylinder 1, the port 17 is opened to the intermediate chamber 14 and the port 18 is opened to the second end chamber 15.

Figure 1:
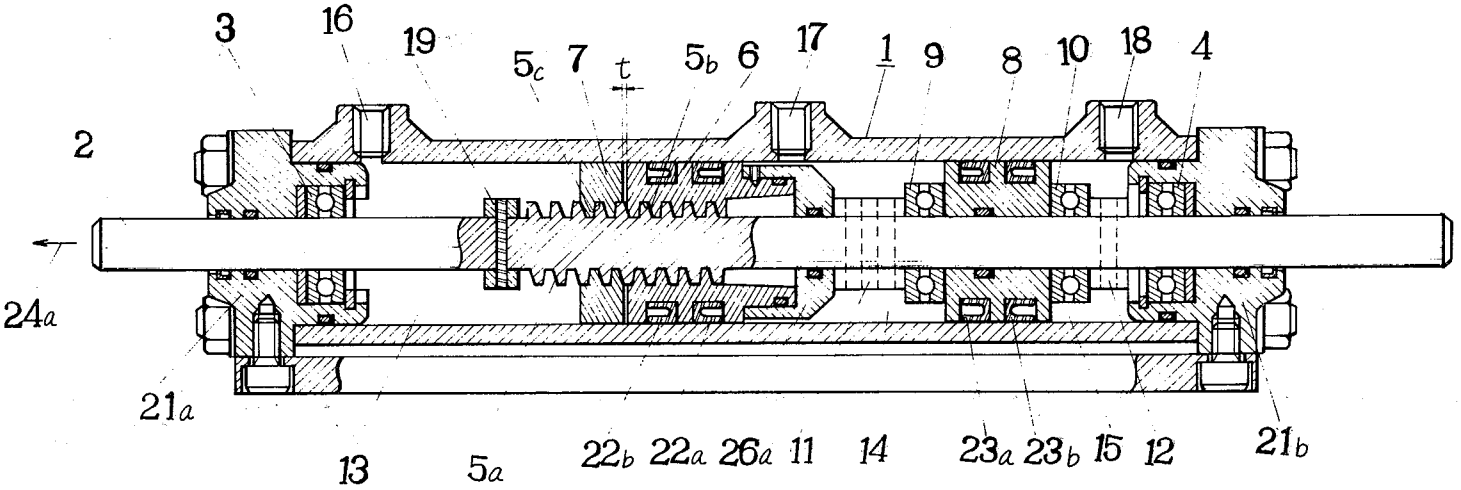
FIG. 1 is a longitudinal sectional view of an improved double acting actuator according to the present invention showing a first state of an operating cycle movements.

The actuator according to this embodiment consists of the above mentioned components. Consequently, when the actuator is used in operation movements, as shown in FIG. 1, the piston rod 2 is located at the end portion in the extreme right direction as the preparatory and initial step while the side wall 26*a* of the first piston 6 contacts the stop ring 11 and the stop ring 12 contacts the thrust bearing 4 of the end wall 21*b*.

At the first step of the operation movements, the selector valve is operated and the port 16 is connected to exhaust, the high pressure hydraulic fluid, such as oil, water, etc. is supplied into the second end chamber 15 through the port 18, and the pressure in the chamber 15 rises and is exerted on the right side of the third piston 8. Thereby, the piston rod 2 is rectilinearly advanced in the direction of an arrow 24*a* (FIG. 1) as far as the position of the piston rod 2 and the third piston 8 as shown in FIG. 2, with the first and second pistons 6 and 7 maintaining their small space *t* therebetween.

Thus, when the stop ring 19 contacts the thrust bearing 3 after the rectilinear movement in the left direction of the arrow 24*a*, the selector valve is controlled so that the hydraulic fluid is supplied into the intermediate chamber 14 through the port 17 with the same pressure as the pressure in the second end chamber 15.

At the second step of the operation movements, with the state as shown in FIG. 2, the selector valve is operated again and the hydraulic fluid is supplied into the intermediate chamber 14 through the port 17 with maintaining the pressure in the second end chamber 15, and the pressure in the intermediate chamber 14 rises to equal the pressure in the second end chamber 15 and is exerted on the side wall 26*a* of the first piston 6. Thereby,, the first piston 6 is advanced to rotate the piston rod 2 in the direction of an arrow 25*a* (FIG. 2) due to the torque exerted responsive to the interengagement of the plural female spiral threads 5*b* of the first piston 6 with the plural male spiral threads 5*a* on the piston rod 2, until the piston rod 2 cannot be rotated any further due to the contact of the second piston 7 with the stop ring 19, while the second piston 7 is also advanced, with the first piston 6 and with maintaining the small space *t*, due to the torque exerted responsive to the rotation of the piston rod 2 through the interengagement of the plural female spiral threads 5*c* of the second piston 7 with the plural male spiral threads 5*a* of the piston rod 2. When, as shown in FIG. 3, the left side wall of the second piston 7 contacts the stop ring 19 the second piston 7 cannot be advanced any further, the rotation of the piston rod 2 in the direction of the arrow 25*a* (FIG. 2) also is stopped. But, as the pressure in the intermediate chamber 14 is still exerted on the side wall 26*a* of the first piston 6, the first piston 6 tends to advance to close the small space *t* between the first piston 6 and the second piston 7 and to rotate the piston rod 2. Consequently, as shown in FIG. 4, the rotary power exerted by the piston rod 2 contacts and loads the second piston 7 against the inside wall of the oval cylinder 1 at the right hand lower part and the left hand upper part thereof, while the advancing power of the first piston 6 contacts and loads the first piston 6 against the inside wall of the oval cylinder 1 at the left hand lower part and the right hand upper part thereof. Thereby, the piston rod 2 is securely locked into the pre-determined position at the end of the rotation in the direction of the arrow 25*a* and is always maintained at the pre-determined position and small space *t* is not changed, since the first and second pistons 6 and 7 are securely engaged with the inside wall of the oval cylinder 1 at four locations. Thus, there is provided an actuator having a high degree of the positioning and/or repeatable accuracy at the end of the longitudinal and rotary movements, and there is further provided an actuator having an excellent durability.

At the third step of the cyclic movements, with the state as shown in FIG. 3, the selector valve is operated again and the port 18 is connected to exhaust, the hydraulic fluid is supplied to the first end chamber 13 through the port 16, and the pressure in the first end chamber 13 is exerted on the second piston 7. Thereby, the piston rod 2 is rectilinearly retracted in the direction of an arrow 24*b* (FIG. 3) and the third piston 8 is returned to the starting position of the third piston 8 as shown in FIG. 5 while the first and second pistons 6 and 7 maintain their spacing *t* on the piston rod 2.

Figure 5:
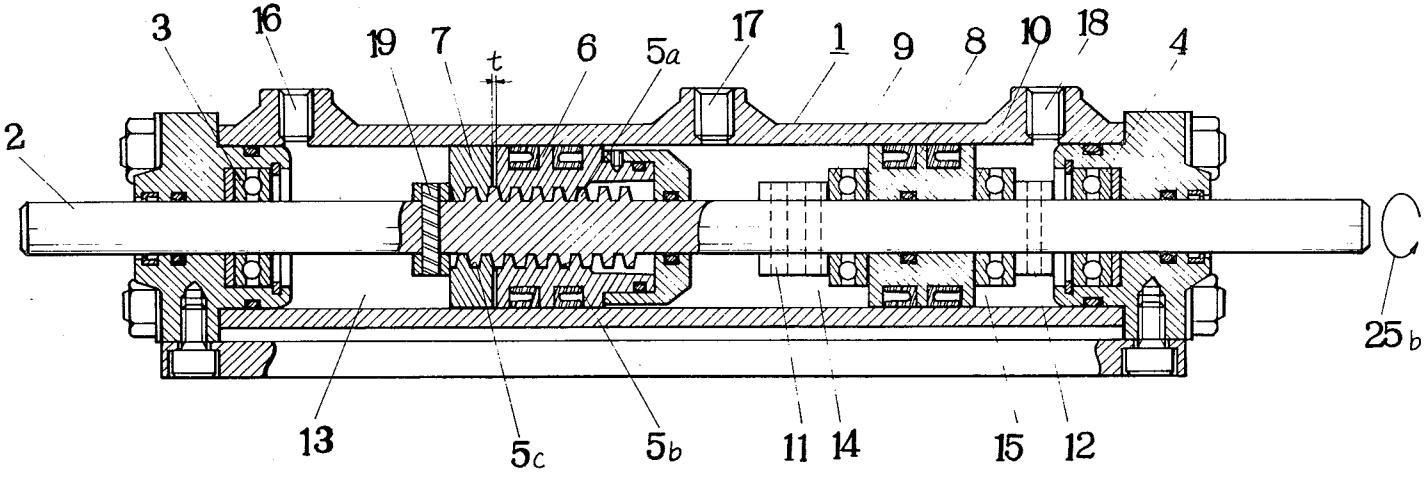

At the fourth step of operation movements, with the state as shown in FIG. 5, the selector valve is operated again and the port 17 is connected to exhaust, while the supply of the hydraulic fluid to the first end chamber 13 is maintained continuously. Thereby, the first and second pistons 6 and 7 return to the respective starting positions in order to rotate the piston rod 2 in the direction of an arrow 25*b* (FIG. 5) as the first and second pistons 6 and 7 and the piston rod 2 are perfectly returned to the first step as shown in FIG. 1.

The above-mentioned operation movements are achieved by operating the selector valve.

In the above-mentioned operation of this embodiment, the operation movements consist of the rectilinear movement in the direction of the arrow 24*a*, the rotary movement in the direction of the arrow 25*a*, the rectilinear movement in the direction of the arrow 24*b* and the rotary movement in the direction of the arrow 25*b* in due order. However, it will be naturally understood that the order of each of the operation movements may be changed at will through changing the order of supplying the hydraulic fluid to the chambers 13, 14 and 15. This is because the cylinder 1 has three ports 16, 17 and 18 opening to the three chambers 13, 14 and 15, respectively, and the hydraulic fluid can be selectively supplied thereto by the selector valve. For example, with the state as shown in FIG. 3, the selector valve is operated and the port 17 is connected to exhaust while maintaining the pressure in the second end chamber 15, the hydraulic fluid is supplied into the first end chamber 13 through the port 16, and the pressure in the first end chamber 13 is exerted on the second piston 7. Thereby, the first and second pistons 6 and 7 are returned to the respective positions as shown in FIG. 2 in order to rotate the piston rod 2 in the direction of the arrow 25*b* as the first and second pistons 6 and 7 and the piston rod 2 are perfectly returned to the second step as shown in FIG. 2. Then, the selector valve is operated again and the port 18 is connected to exhaust while the supplying of the hydraulic fluid to the first end chamber 13 is maintained. Thereby, the piston rod 2 is rectilinearly retracted in the direction of the arrow 24*b* and the pistons 6, 7 and 8 are also returned to the respective starting positions as shown in FIG. 1. Namely, the operation movements of this example consist of the rectilinear movement in the direction of the arrow 24*a*, the rotary movement in the direction of the arrow 25*a*, the rotary movement in the direction of the arrow 25*b* and the rectilinear movement in the direction of the arrow 24*b* in due order.

Figure 6:
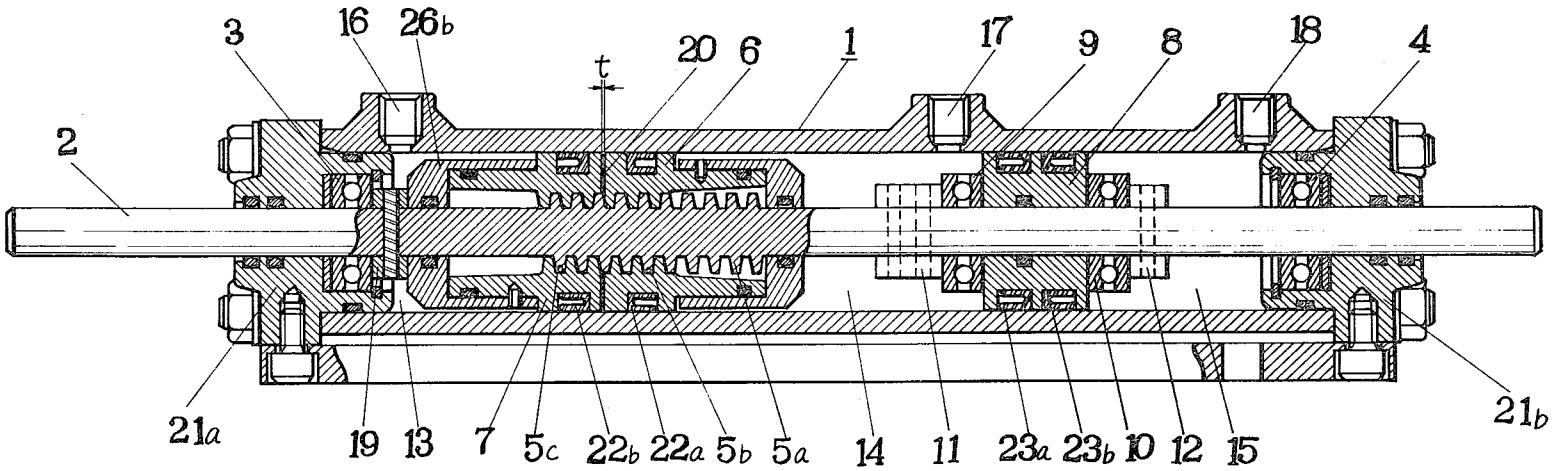
FIG. 6 is a longitudinal sectional view of another embodiment of the actuator according to the present invention.

Referring to FIG. 6, there is shown another embodiment of the actuator according to the present invention. The actuator according to this embodiment, which is very similar as the actuator according to the afore-mentioned embodiment, comprises a cylinder 1 of oval cross section, two end walls 21*a* and 21*b* closing the opposite ends of the cylinder 1, three types of pistons, i.e. a first piston 6, a second piston 7 and a third piston 8, and a piston rod 2 which is watertightly extended through the three pistons and the end walls. The second piston 7 is formed to the same shape as the first piston 6 and is provided with a side wall 26*b* of a C-shaped cross section and a rubber packing 22*b*. An elastic means 20, such as a rubber spring, a spring washer, etc., is inserted into a small space *t* formed between first and second pistons 6 and 7, and these first and second pistons 6 and 7 are provided with plural female spiral threads 5*b* and 5*c*, respectively, which are watertightly and movably engaged with plural male spiral threads 5*a* on the piston rod 2.

The actuator according to this embodiment consists of the above mentioned compoments which are very similar to those of the actuator according to the aforementioned embodiment. Consequently, the operation movements of this actuator are identical with those of the actuator according to the afore-mentioned embodiment. But, in this embodiment, the positioning of the piston rod 2 is effected at the begining and the end of the operation movements, and these operation movements are kept to a high degree of a balance by the elastic means 20 because the elastic means 20 exhibits a buffer action between the first and second pistons 6 and 7.

It will be naturally understood that the elastic means 20 may be utilized in the actuator according to the first-mentioned embodiment with a view to providing the buffer action.

In regard to the embodiments described herein, it will be recognized that the actuator according to the present invention achieves a high degree of the positioning and repeatable accuracy at the beginning and/or the end of the operation movements which is effected by the two pistons having the very small space therebetween, and, further, achieves some types of operation movements combining the rectilinear and rotary movements.

The invention herein has been described with reference to a number of embodiments, which embodiments have been selected solely for exemplary pursoses. It is therefore stated that the concepts hereof may be embodied in other structual designs so long as the advantages described may be accomplished without adverse effects.

What is claimed is:

1. An actuator, operated by hydraulic fluid under pressure, comprising, in combination, a cylinder having a non-circular cross-section and having a center axis; end walls closing the opposite ends of said cylinder; first, second and third non-circular pistons conformingly engaged in said cylinder dividing the cylinder interior into first and second end chambers and an intermediate chamber, with said first and second pistons having a small axial spacing therebetween; said first end chamber being defined axially by one end wall and said second piston, said second end chamber being defined axially by the other end wall and said third piston, and said intermediate chamber being defined axially by said first and third pistons; a piston rod, extending through said pistons and said end walls, having at least one male spiral thread with a predetermined helical angle at a predetermined pitch, said piston rod extending along said center axis of said cylinder, said first piston being provided with at least one female spiral thread engaged with said male spiral thread of said piston rod; said third piston and said piston rod being relatively rotatable; abutment means on opposite sides of said third piston locking said third piston against axial displacement along said piston rod; limit means on said piston rod engageable with said one end wall, to limit movement of said piston rod outwardly through said one end wall, and engageable by said second piston; and three ports each opening to a respective one of said three chambers, and through which hydraulic fluid is selectively supplied into and exhausted from said three chambers, said actuator having an initial position in which said abutment means engage said other end wall and said first piston, and said limit means is spaced axially from said second piston and said one end wall; said third piston, responsive to supply of pressure fluid to either side thereof with the other side thereof connected to exhaust, effecting only rectilinear movement of said piston rod and said first and second pistons as limited by engagement of said limit means and said abutment means with the associated end walls, without rotation of said piston rod; said first and second pistons, with said third piston remaining stationary, due to equal pressure on its opposite sides, and restraining rectilinear movement of said piston rod, conjointly moving axially of said piston rod, to rotate the latter in respective opposite directions while maintaining said small axial spacing therebetween, responsive to supply of pressure fluid to one of said first end intermediate chambers with the other of said first end and intermediate chambers connected to exhaust, respectively; said first piston, upon engagement of said second piston with said limit means, exerting a torque on said second piston, tending to decrease said small axial spacing, firmly engaging said second piston with the interior surface of said cylinder at two circumferentially spaced first points with the reaction torque firmly engaging said first piston with the interior surface of said cylinder at two circumferentially spaced second points, with such action occurring, in the opposite sense of rotation, when said first piston engages said abutment means; whereby said piston rod is firmly locked at each of its limits of rotation.

2. An actuator, as claimed in claim 1, including an elastic means inserted in said small axial spacing between said first and second pistons.

3. An actuator as claimed in claim 1, wherein said second piston has the same shape as the first piston, said first and second pistons extending in opposite axial directions on said piston rod with said small axial spacing therebetween.

4. An actuator as claimed in claim 3, including an elastic means inserted into said small axial spacing between said first and second pistons.

* * * * *